US008826621B2

(12) United States Patent
Noble

(10) Patent No.: US 8,826,621 B2
(45) Date of Patent: Sep. 9, 2014

(54) PANEL SUPPORT AND ADJUSTMENT MECHANISM

(76) Inventor: Angus Noble, Totnes (GB)

( * ) Notice: Subject to any disclaimer, the term of this patent is extended or adjusted under 35 U.S.C. 154(b) by 0 days.

(21) Appl. No.: 13/582,732

(22) PCT Filed: Feb. 4, 2011

(86) PCT No.: PCT/GB2011/000149

§ 371 (c)(1),
(2), (4) Date: Sep. 16, 2012

(87) PCT Pub. No.: WO2011/095779

PCT Pub. Date: Aug. 11, 2011

(65) Prior Publication Data

US 2013/0036680 A1 Feb. 14, 2013

(30) Foreign Application Priority Data

Feb. 4, 2010 (GB) ..... 1001783.8

(51) Int. Cl.
*E04B 2/00* (2006.01)
*E04F 11/18* (2006.01)

(52) U.S. Cl.
CPC ..... *E04F 11/1851* (2013.01)
USPC ..... 52/584.1; 52/766; 52/767

(58) Field of Classification Search
USPC ..... 52/584.1, 766, 767, 800.16, 127.8, 52/204.64, 204.65, 208
See application file for complete search history.

(56) References Cited

U.S. PATENT DOCUMENTS 4,763,453 A * 8/1988 Horgan, Jr. ..... 52/127.8
4,920,717 A * 5/1990 Hooper, Jr. ..... 52/204.597
6,912,818 B2 * 7/2005 Sprague ..... 52/208
7,730,682 B2 * 6/2010 Nash ..... 52/238.1
7,963,077 B2 * 6/2011 Lin ..... 52/204.597
8,181,405 B2 * 5/2012 Nash ..... 52/238.1
2009/0031653 A1 * 2/2009 Nash ..... 52/238.1
2010/0307082 A1 * 12/2010 Nash ..... 52/238.1
2013/0036680 A1 * 2/2013 Noble ..... 52/126.4

FOREIGN PATENT DOCUMENTS

DE 102009008307 10/2009
DE 102009008307 A1 * 10/2009 ..... E04F 11/18
EP 1647663 4/2006
EP 1700990 9/2006
EP 2112296 10/2009
FR 2930270 10/2009
WO 2009017873 2/2009

OTHER PUBLICATIONS

English Translation of DE 102009008307.*
International Search Report, dated Aug. 2, 2011.
IPRP, dated Aug. 7, 2012.

* cited by examiner

*Primary Examiner* — Andrew J Triggs
(74) *Attorney, Agent, or Firm* — Crose Law LLC; Bradley D. Crose

(57) ABSTRACT

A mechanism for the adjustment of the vertical alignment of a panel member contained within an elongated channel section comprising; one or more means of clamping the panel member with an adjustable force; and one or more support means for supporting the panel member within the channel section; wherein the one or more means of clamping the panel member is arranged to adjustably tilt and secure the panel member so as to be maintained substantially vertically aligned even when the elongated channel section is secured to a surface which is not substantially horizontal.

9 Claims, 10 Drawing Sheets

PANEL SUPPORT AND ADJUSTMENT MECHANISM

FIELD OF THE INVENTION

The present invention relates to a panel support and adjustment mechanism. In particular but not exclusively the invention relates to a panel support and adjustment mechanism for glass balustrades, partitioning, glass staircases and safety barriers.

BACKGROUND OF THE INVENTION

It is known to support panel members for use in a balustrade system in an elongated channel section that is bolted to the floor or any other suitable structure. The glass balustrade panel is inserted into the channel section and retained in position by the use of casting with a setting resin, clamping with bolts or with the use of wedges.

All of these methods have disadvantages. Casting in place with a setting resin has the disadvantage of making it difficult to move or replace the glass in the event of damage either during installation or during the subsequent lifetime of the balustrade. Additionally it takes a while for the resin to set and during this time the member must be supported by an additional means. Clamping with bolts or wedges requires the channel section to be bolted to the supporting structure with absolute alignment accuracy. This is to ensure that the glass balustrade is substantially vertical. Very small angular errors in the vertical alignment of the channel section as a result of an uneven floor surface or supporting structure can result in large displacements at the top of the balustrade.

It is an aim of embodiments of the present invention to at least partially mitigate the disadvantages of known panel member support and alignment methods.

BRIEF SUMMARY OF THE INVENTION

In a first aspect of the invention there is provided a mechanism for the adjustment of the vertical alignment of a panel member contained within an elongated channel section comprising;

one or more means of clamping the panel member with an adjustable force; and one or more support means for supporting the panel member within the channel section;

wherein the one or more means of clamping the panel member is arranged to adjustably tilt and secure the panel member so as to be maintained substantially vertically aligned even when the elongated channel section is secured to a surface which is not substantially horizontal.

Embodiments of the invention have the advantage that they provide a means to adjust the vertical alignment of the panel member, regardless of the orientation of the channel section to the supporting structure.

Embodiments of the invention have the additional advantage that the panel member can be removed or replaced at any time with the use of a simple tool.

Embodiments of the invention have a yet further advantage that they can also accommodate panel members comprising a range of different thicknesses.

In at least one embodiment, the support means is a support member.

BRIEF DESCRIPTION OF THE DRAWINGS

Embodiments of the invention will now be described with reference to the accompanying figures in which.

DETAILED DESCRIPTION OF THE INVENTION

Figure 1:
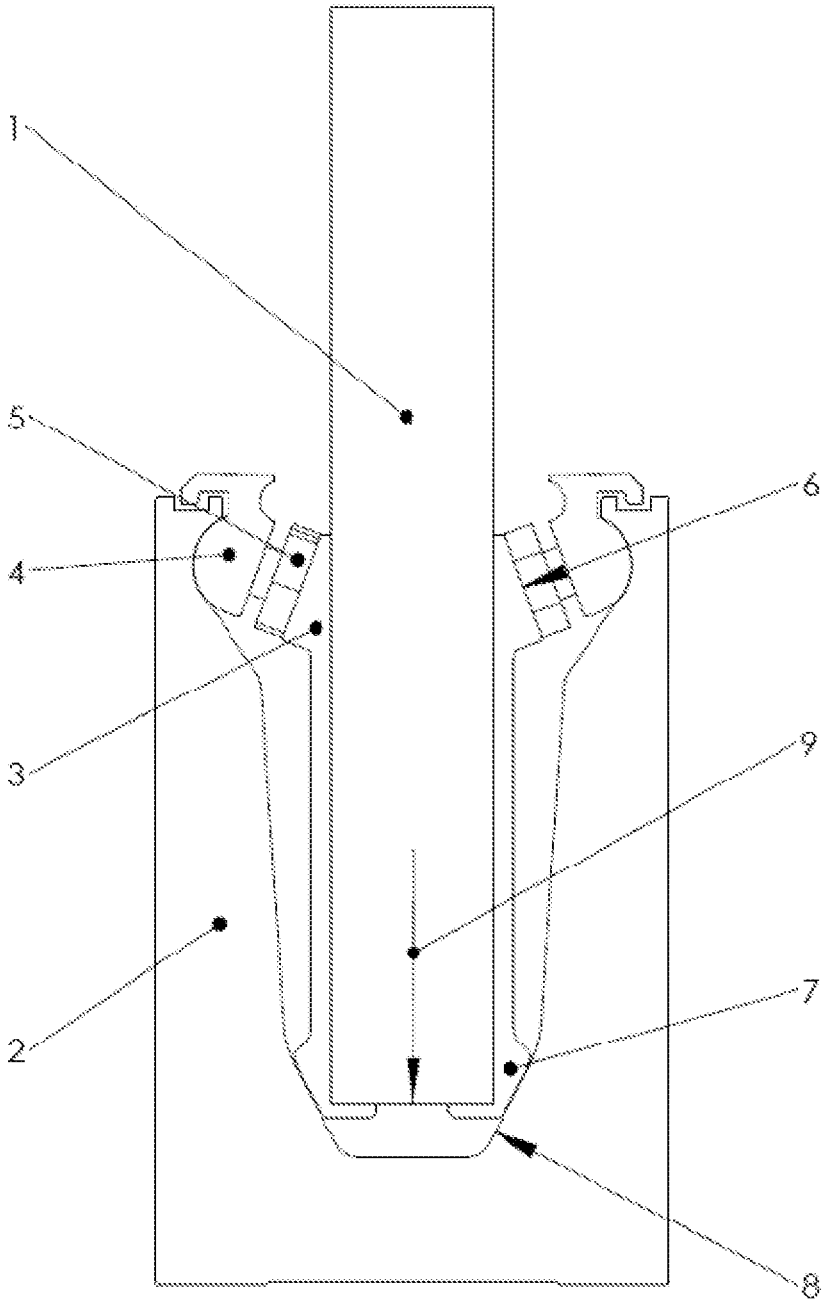
FIG. 1 is a cross section of the mechanism and channel section with a panel member secured in place.

In a first embodiment of the present invention FIG. 1 shows a schematic drawing of a channel extrusion profile 2 with a glass panel 1 in place.

A support plate 3 is attached to each side of the glass or panel. This support plate 3 can be of varying thickness to accommodate glass or panels of a range of different thicknesses.

The assembly of the glass or panel member 1, and support plate 3 is placed into the channel section extrusion 2 where it wedges into the substantially V shaped profile at the base of the channel section extrusion. It is to be understood that this locates the lower edge of the glass or panel assembly and also centres the glass or panel in the channel extrusion 2.

Two threaded clamping extrusions comprising of parts 4, with threaded fasteners 5 are placed on each side of the glass or panel member assembly and are also located in grooves running along each side of channel extrusion 2. It is to be understood that the invention would also function without the requirement of the use of locating grooves.

As the fasteners 5 are wound out of clamping extrusion 4 they create a wedging action against the angled ramps 6 of the support plate profiles 3. This opposing wedging action clamps the glass or panel member in position in the channel extrusion 2. By adjusting the fasteners 5 each side of the glass or panel assembly, the glass or panel member can be set at a range of angles relative to channel section extrusion 2.

Due to the angle of the ramps 6 on the side of support plate 3, this side clamping force also generates a downward component 9 that forces the glass or panel assembly into the substantially V shaped profile 8 at the base of channel section extrusion 2. This clamps the lower edge of the glass or panel member assembly at the same time.

The clamping extrusions 4 with fasteners 5 will self align with support plate 3, depending on the angle the glass or panel member assembly has been positioned.

Figure 2:
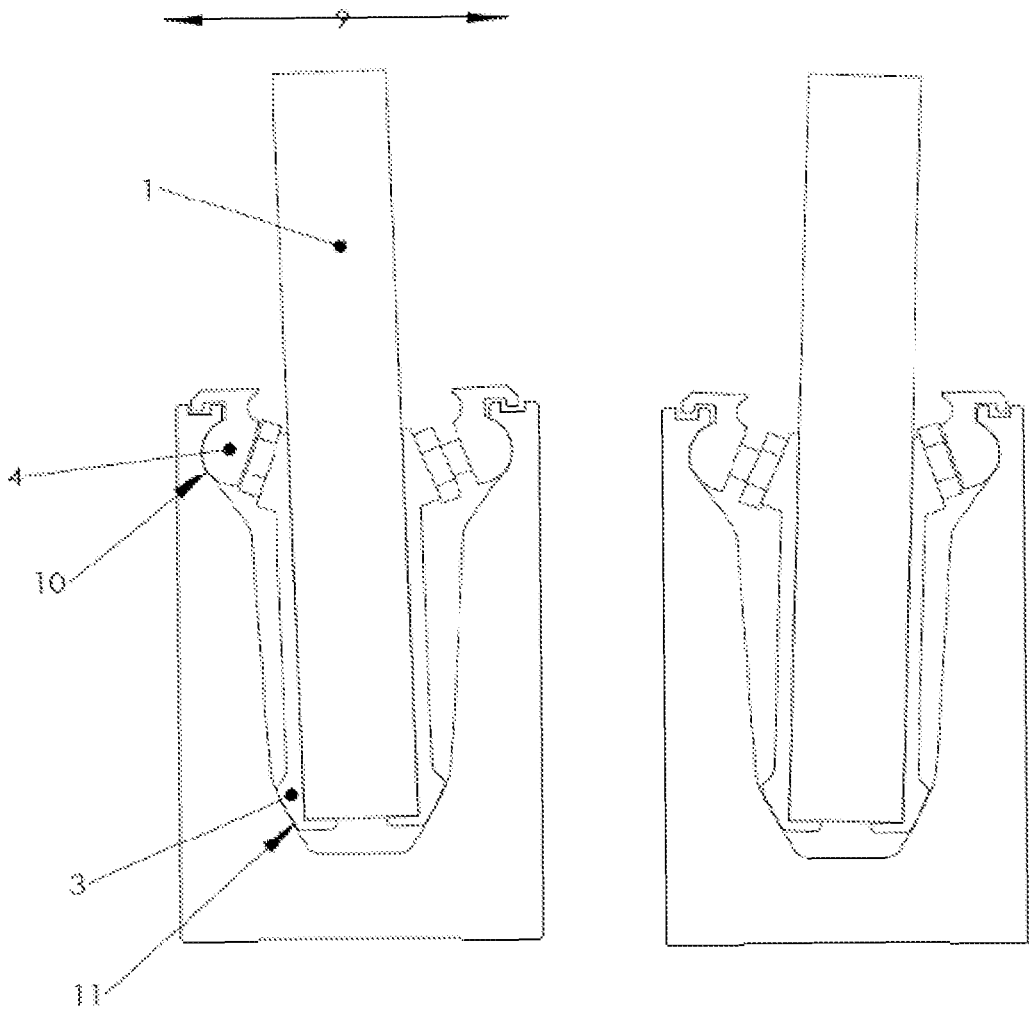
FIG. 2 is cross section showing the angular displacement of the panel member possible by the adjustment of the bolts applying the clamping force.

FIG. 2 shows a schematic drawing of the angular movement possible by adjusting the fasteners 5 on each side of the glass or panel member 1 and support plate 3 assembly.

Once the glass panel 1 is adjusted to the position required, fasteners both sides are tightened equally to generate the full clamping force required to keep the glass panel 1 in position.

This clamping force also generates the downward component that wedges the lower edge of the glass or panel member assembly into the V shaped profile 11 of the channel section extrusion 2.

Clamping extrusion 4 with fasteners 5 will self align in the radius groove 10 of channel section extrusion 2 depending on the angle glass or panel member 1 is clamped.

Figure 3:
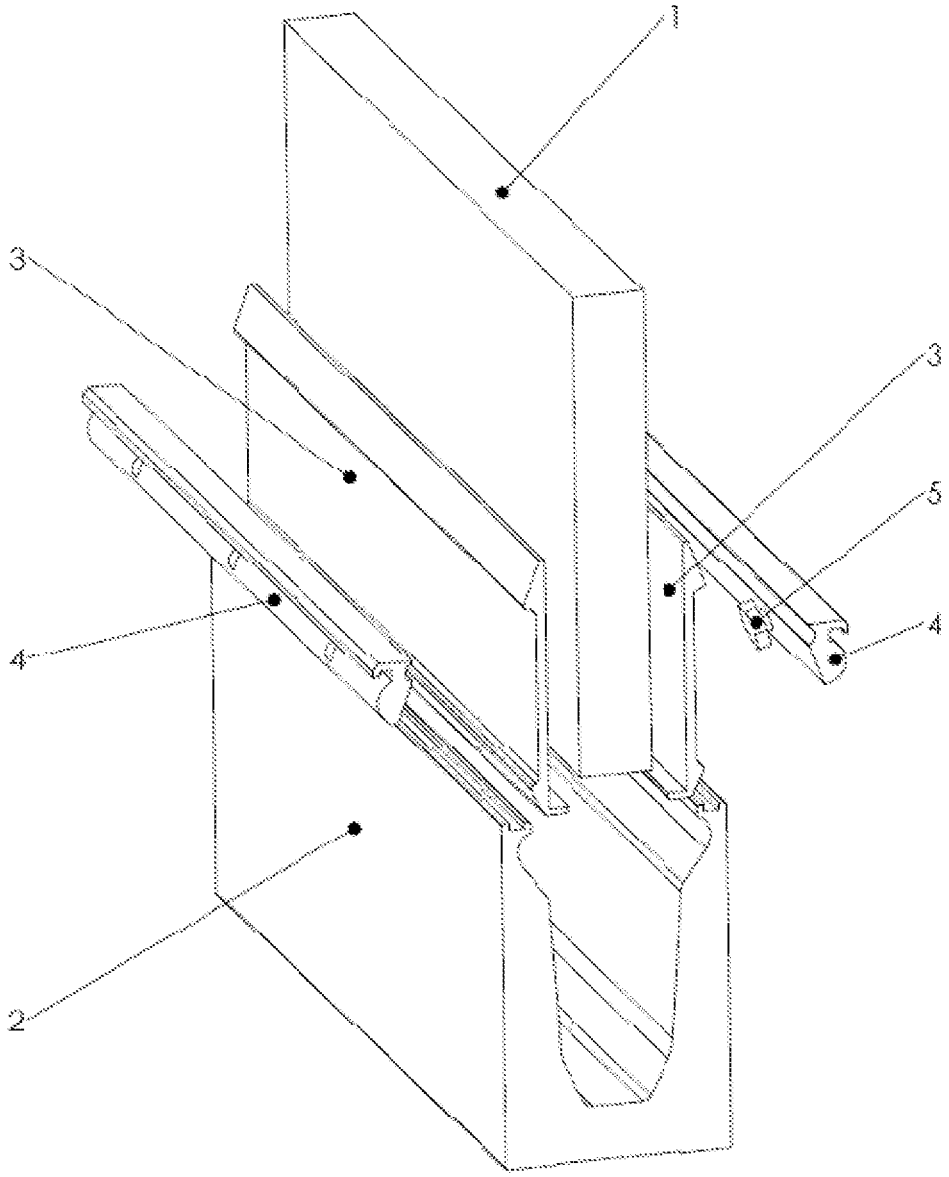
FIG. 3 is an exploded perspective view of the various components of the system.

FIG. 3 shows a perspective exploded view of a section of the various components of the system. Shown is clamping extrusion 4 with tapped holes positioned at intervals along the section. Threaded fasteners are inserted into these tapped holes and when wound out of the extrusion 4, generate the adjustment and clamping force required on the glass or panel member 1 and support plate 3 assembly.

Figure 4:
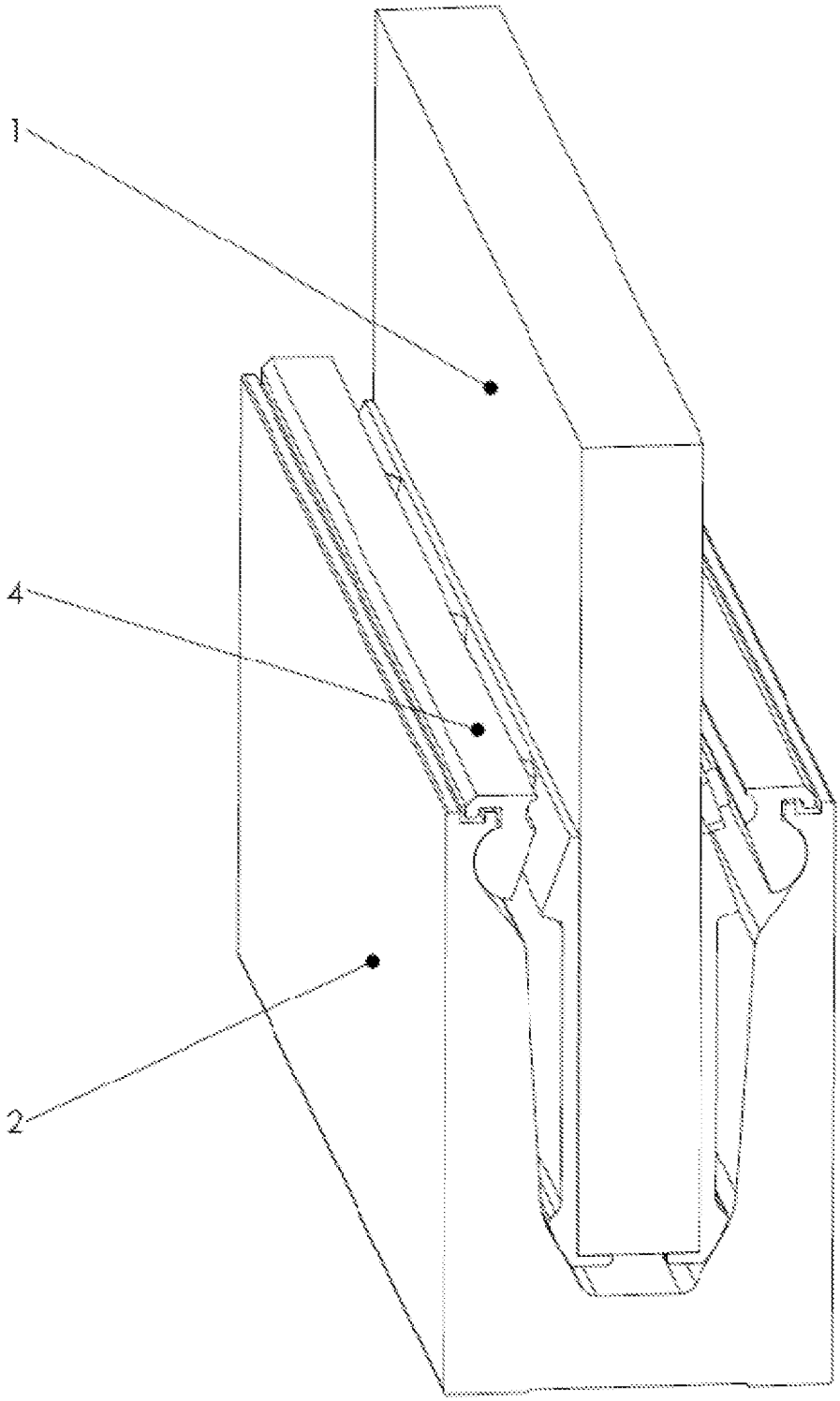
FIG. 4 is a perspective view of a section of channel support showing the panel member with clamping support plate in position.

FIG. 4 shows a perspective view of the various components of the system. Glass or panel member 1 channel section extrusion 2 and support plate 3.

Figure 5:
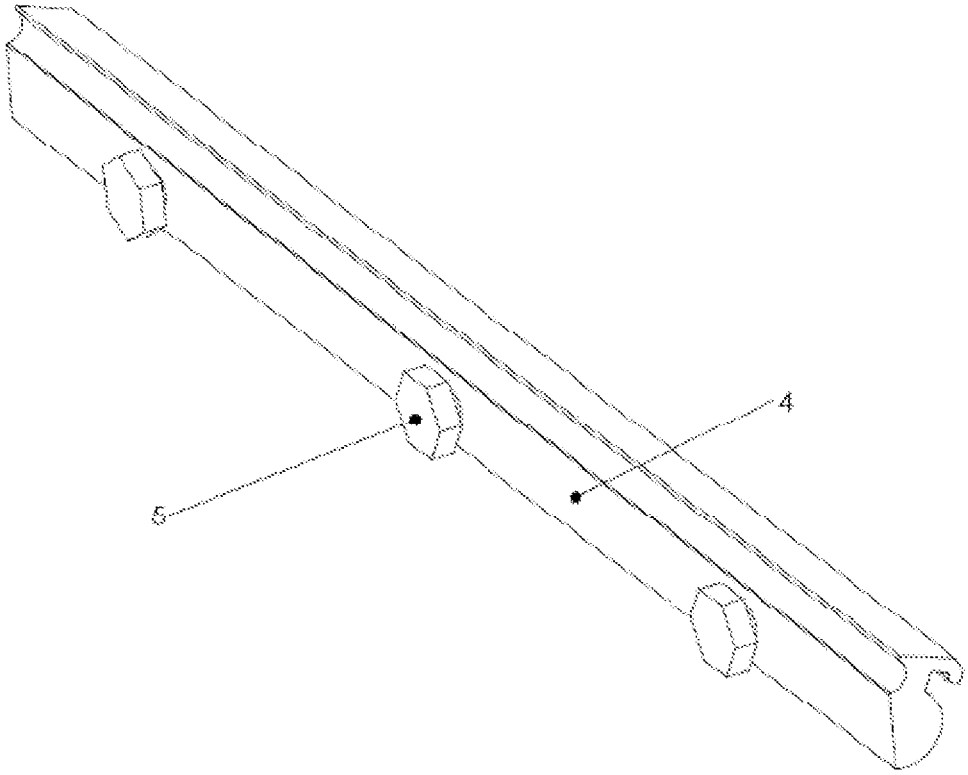
FIG. 5 is a perspective view of a section of clamping support plate with a clamping force generating component in place.

FIG. 5 shows a perspective view of a section of clamping extrusion 4 showing fasteners 5 in position.

In an alternative embodiment of the invention, the clamping force is generated by the use of expanding wedges instead of threaded fasteners.

The core principal of the invention, generating a downward component from the side clamping force, by having the clamping force from each side of the panel angled down towards the panel centre, is retained. This downward component wedges the panel assembly into the substantially V shaped profile in the base of the channel section, this results in a clamping force being generated over the full depth of the panel assembly retained in the channel section.

Detailed Description of an Alternative Embodiment

Figure 6:
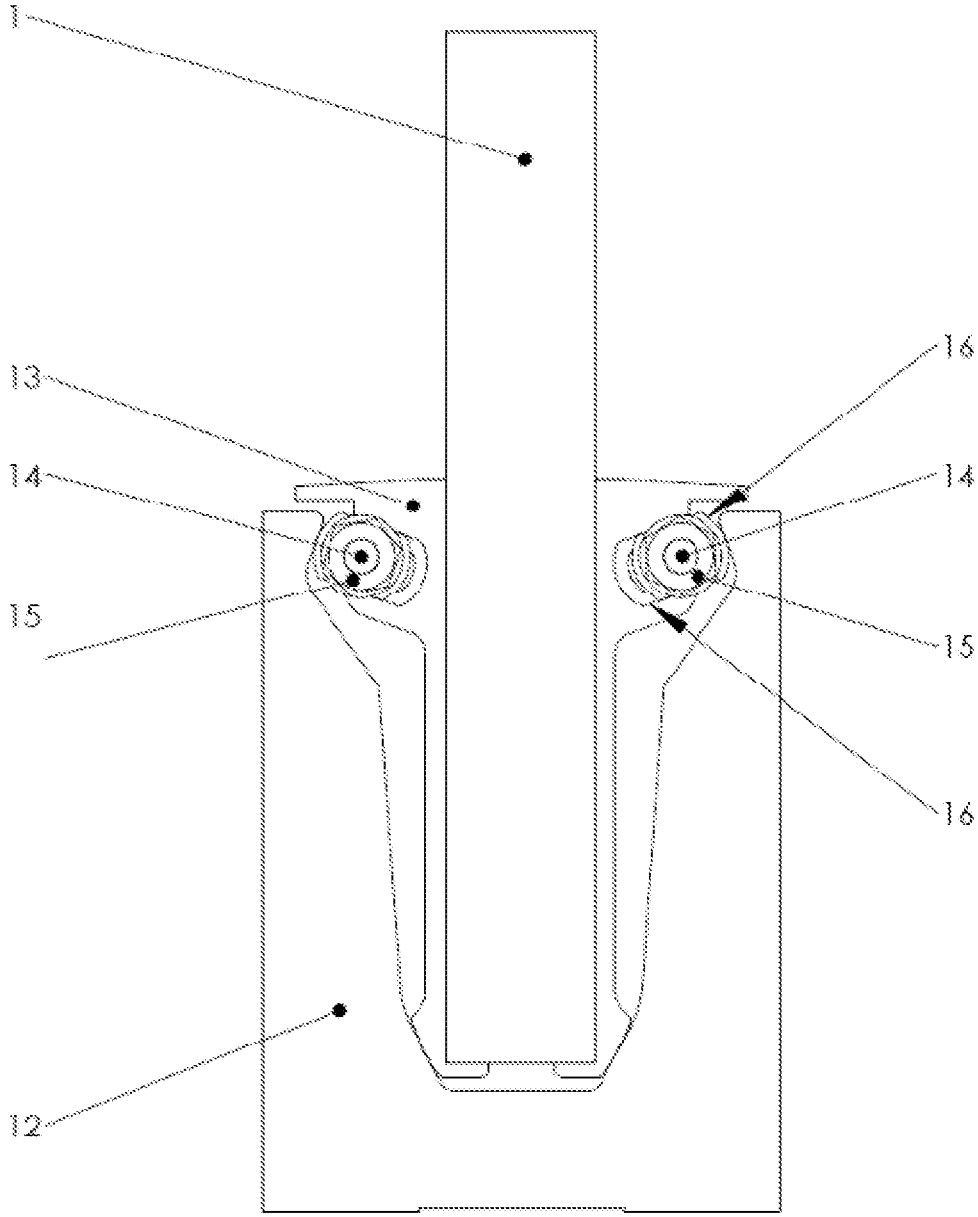
FIG. 6 is a cross section of a second embodiment showing an alternative arrangement of extrusions with a panel clamped in place.

FIG. 6 shows a schematic drawing of a channel extrusion profile 12 with a glass or panel member 1 in place.

A support plate extrusion 13 is attached to each side of the glass or panel member. This support plate extrusion 13 can be of varying thickness to accommodate glass or panels of a range of different thicknesses.

The assembly of glass or panel member 1, and support extrusion extrusions 13, is placed into the channel section extrusion 12, where it wedges into the substantially V shaped profile at the base of the channel section extrusion. This locates and clamps the lower edge of the glass or panel member assembly and also centres the glass or panel member in the channel section extrusion 12. Two assemblies of expanding wedges 16 are placed in angled grooves in support plate extrusions 13 on each side of the glass or panel member assembly. As the wedges expand they press against the sides of channel extrusion 12 and support plate extrusions 13. This opposing wedging action clamps the glass or panel member in position in the channel extrusion 12. By adjusting the wedges 16, each side of the glass or panel member assembly, the glass or panel member can be set at a range of angles relative to channel section extrusion 12. The angled clamping force also generates the downward component that clamps the lower edge of the glass or panel member in the substantially V shape profile of channel extrusion 12.

Figure 7:
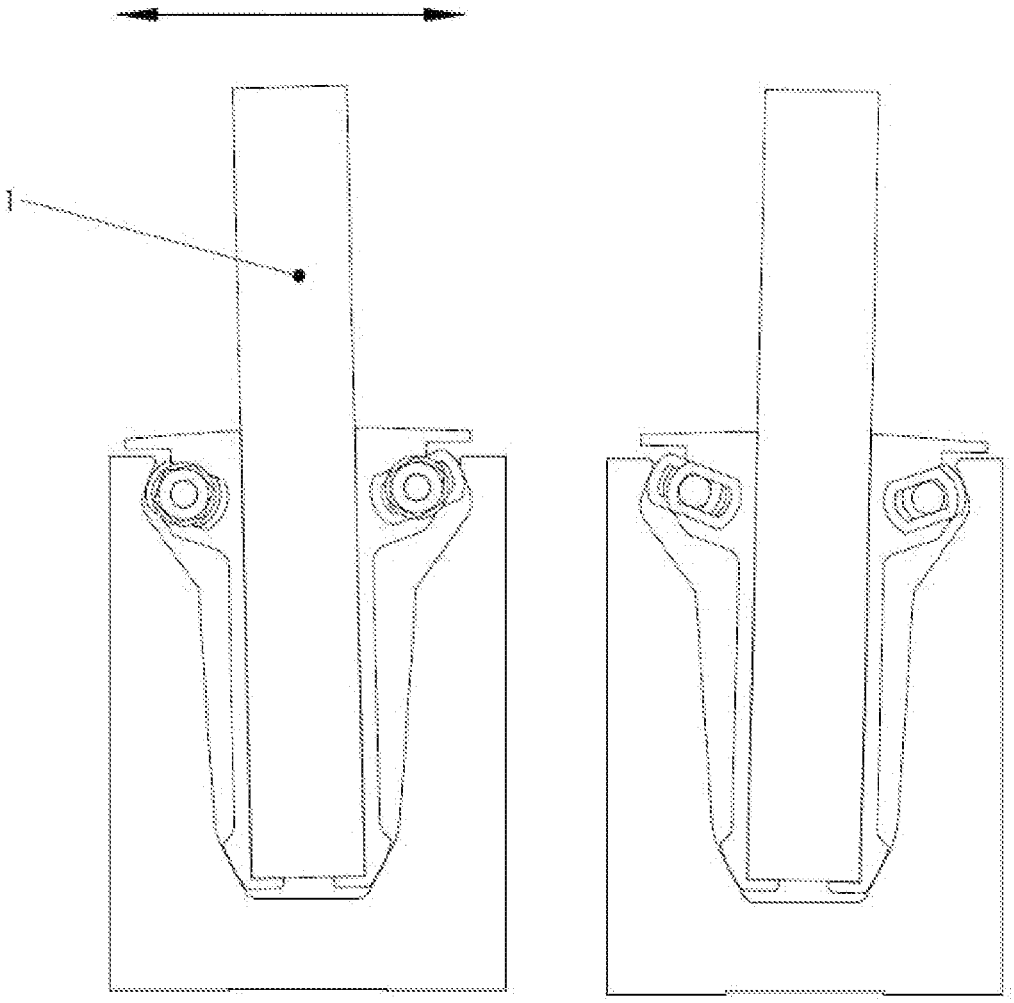
FIG. 7 is a cross section showing the angular displacement of the panel member possible by the adjustment of the second embodiment of the panel member clamping arrangement.

FIG. 7 shows a schematic drawing of the angular movement possible by adjusting the expanding wedges 16 on each side of the glass or panel member 1 and support plate extrusion 13 assembly.

Once the glass or panel member 1 is adjusted to the position required, wedge assemblies both sides are tightened equally to generate the full clamping force required to keep the glass or panel member 1 in position. This clamping force also generates the downward component that wedges the lower edge of the glass or panel member assembly into the V profile of the channel section extrusion 12.

Figure 8:
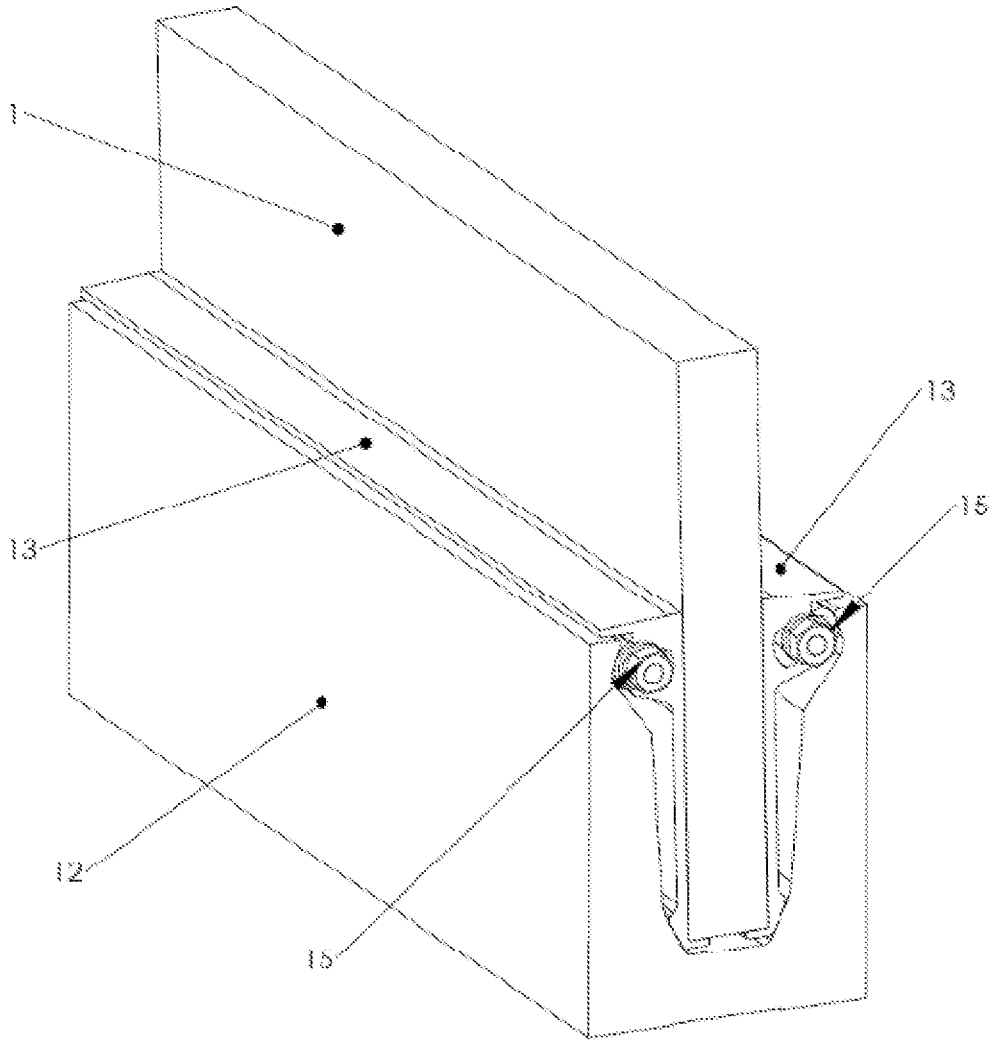
FIG. 8 is a perspective view of a section of channel support showing the panel member with clamping support plates of the second embodiment in position. Tightening the nuts generates the required clamping force.

FIG. 8 shows a perspective view of a section of the various components of the system. Shown is channel extrusion 12 with glass or panel member 1 and support plate extrusions 13 each side. Shown are two nuts at the end of the expanding wedge assemblies. Tightening these nuts expands the wedges and generates the side clamping force required on the glass or panel member 1 and support plate extrusion 13 assembly.

Figure 9:
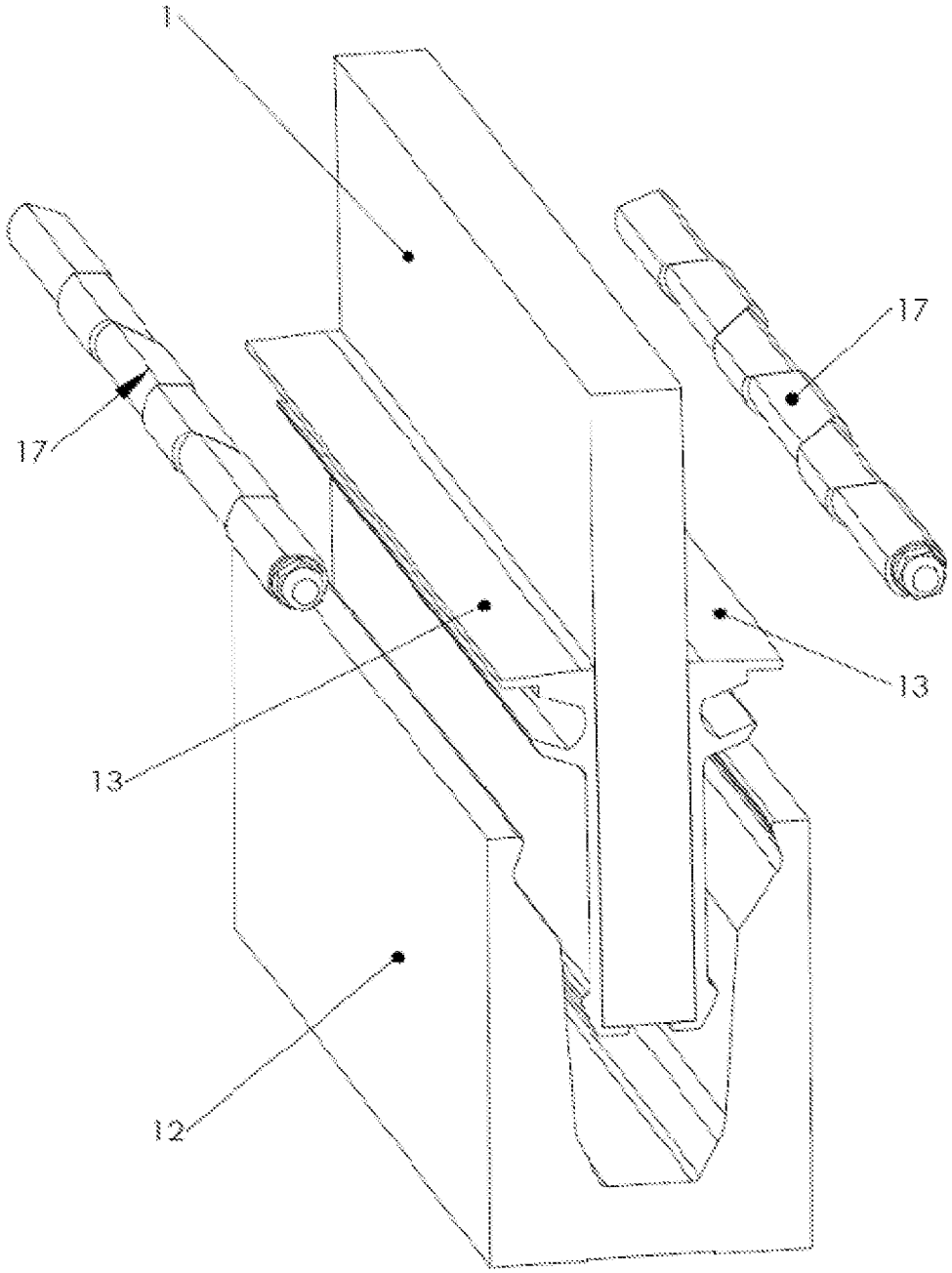
FIG. 9 is an exploded perspective view of the various components of the second embodiment.

FIG. 9 shows a perspective exploded view of a section of the various components of the system. Shown are expanding wedge assemblies 17 glass or panel member 1 support plate extrusions 13 and channel section extrusion 12.

Figure 10:
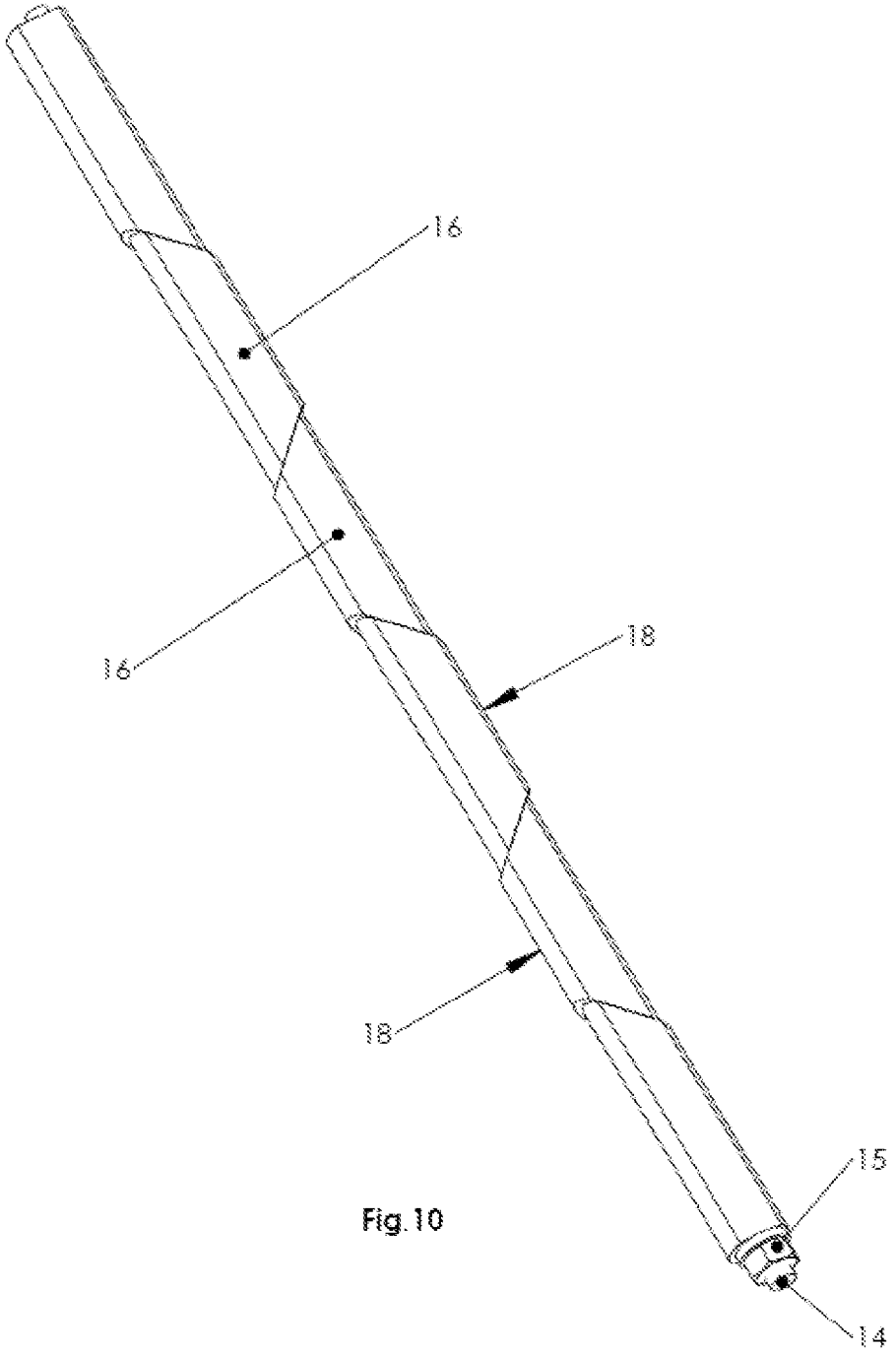
FIG. 10 is a perspective view of a section of the clamping support plate with a threaded rod in place.

FIG. 10 shows an expanding wedge assembly. As the nut 15 on the threaded rod 14 are tightened, the various segments of extrusions 16 are squeezed together. This results in the segments sliding in opposite directions as shown by the arrows 18 and generating a side force on channel section extrusion 12 and support plate extrusion 13.

It is to be understood that alternative embodiments of the invention could make the clamping extrusion 4 and support plate extrusion 13 parts from a process other than extrusion such as but not limited to machined or injection moulded processes.

It is to be understood that alternative embodiments of the invention could use panel members made from other rigid body materials such as but not exclusively wood, steel, plastic, plywood, or plasterboard.

Other arrangements are also useful.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

What is claimed is:

1. A mechanism for the adjustment of the vertical alignment of a panel, a first edge of the panel contained within an elongated channel section, the elongate channel section having:

an open top;

an inside surface, having opposing side walls spaced from one another by a section width;

a base connecting the side walls and located below the open top by a section depth; and a section length at right angles to the section width and the section depth;

the mechanism comprising:

one or more support means for supporting the first edge of the panel within the channel section parallel to the section length of the elongate channel section the support means comprising distal, and opposing, faces, the support means configured to be arranged within the elongate channel section such that the faces are substantially parallel to the opposing side walls of the inside surface, such that the faces abut opposing sides of the panel adjacent to the first edge;

one or more clamping parts for clamping the panel with an adjustable force, the one or more clamping parts arranged to adjustably tilt and secure the panel so as to be maintainable substantially vertically aligned even when the elongated channel section is secured to a surface which is not substantially horizontal, the one or more clamping parts comprising:

a threaded screw fastening having an axial length, the threaded screw fastening arrangable between the distal faces of the support means and the opposing side walls of the elongated channel section, such that the axial length of the threaded screw fastening is parallel to the section length of the elongated channel section;

a number of discrete abutting sliding wedge segments threaded on the threaded screw fastening; and a nut arranged on the threaded screw fastening to squeezes together the sliding wedge segments when tightened;

wherein the one or more clamping parts are configured such that as the nut is tightened on the threaded screw fastening, the sliding wedge segments slide in opposite directions at right angles to and away from the axial length, thereby creating a clamping force that urges one of the faces of the support means against one of the sides of the panel adjacent to the first edge, and urges the one of the faces away from one of the side walls of the elongate channel section the clamping force being adjustable by means of varying the distance between the one of the faces of the support means and the one of the side walls of the inside surface of the elongated channel section and the distance between the one of the side faces of the support means and the one of the side walls of the inside surface of the elongated channel section being adjustable by means of turning the nut on the threaded screw fastening.

2. A mechanism as in claim 1, wherein the support means comprises at least one angled ramp which the clamping parts are wedgable such that the adjustable force applied to the support means is at some inclined angle to the panel, such that there is a downward force component which clamps the first edge of the panel in the elongated channel section.

3. A panel support system, comprising two or more of the mechanisms of claim 1, positioned along the section length of an elongated channel section.

4. A panel support system as in claim 1, arranged to distribute the adjustable force over the section length of the panel.

5. A panel support system as in claim 1 further comprising a panel.

6. A panel support system as in claim 5, wherein the panel is made from glass, wood, steel, plastic, plywood, or other rigid material.

7. A method of adjusting the vertical alignment of a panel within an elongate channel section, the method comprising the steps of: providing the panel member support system of claim 1 within the elongate channel section; placing the panel within the elongated channel section; and tilting and securing one or more of the clamping parts.

8. A panel support system as in claim 1, further comprising an elongated channel section for receiving a panel therein, the support means, the threaded screw fastening and the clamping parts located within the elongate channel section.

9. A panel support system as in claim 1, arranged to apply the adjustable force at a number of discrete locations along an edge length of the first edge of the panel.

* * * * *